United States Patent [19]

Muller et al.

[11] 4,172,522

[45] Oct. 30, 1979

[54] SKI BOX AND PACKAGE

[75] Inventors: John J. Muller, East Hampton; Roland F. Breault, Madison, both of Conn.

[73] Assignee: Olin Corporation, New Haven, Conn.

[21] Appl. No.: 914,638

[22] Filed: Jun. 12, 1978

[51] Int. Cl.[2] ..... B65D 7/24

[52] U.S. Cl. ..... 206/315 R; 224/45 S; 229/22; 229/37 E

[58] Field of Search ..... 24/73 SG, 81 SK; 150/52 R; 206/315 R, 521, 591; 211/60 SK; 224/5 Z, 45 S; 229/22, 37 E; 280/11.37 A, 11.37 C, 11.37 K

[56] References Cited

U.S. PATENT DOCUMENTS

| | | | |
|---|---|---|---|
| 1,701,059 | 2/1929 | Andrews | 229/22 X |
| 2,180,686 | 11/1939 | Lorinovich | 224/45 S X |
| 3,199,765 | 8/1965 | Locke | 229/22 X |
| 3,837,548 | 9/1974 | Nerger | 224/45 S |
| 3,891,136 | 6/1975 | Woeste | 229/22 |
| 3,921,871 | 11/1975 | Heil | 224/45 S |

FOREIGN PATENT DOCUMENTS

| | | | |
|---|---|---|---|
| 2132731 | 1/1973 | Fed. Rep. of Germany | 224/45 S |
| 2210833 | 9/1973 | Fed. Rep. of Germany | 224/45 S |

*Primary Examiner*—Stephen Marcus

*Attorney, Agent, or Firm*—William W. Jones; Paul J. Lerner

[57] ABSTRACT

An improved box for packaging a pair of skis is provided, whereby the boxed skis will be held securely in place and will be protected against damage which may occur in shipping or handling. The skis are held relatively immobilized within the box without the need for inserting any spacers or the like into the box. The ends of the box are constructed to serve as impact absorbers should the box be dropped on its ends while the skis are in it. The box is shaped to provide improved nesting and stacking characteristics for storage prior to shipment.

2 Claims, 5 Drawing Figures

SKI BOX AND PACKAGE

This invention relates to a box for snow skis. The box is typically used for storing and/or shipping the skis from the manufacturer to the distributor and customer.

In the past, snow skis have been transported or shipped from the manufacturer to the distributor or customer by packaging a pair of skis in a plastic bag, one ski on top of the other so that the bottom of the upper ski rests upon the top of the lower ski and with the shovel end of each of the skis being adjacent to each other. The bag and ski pair were then slid into a long carton having a square cross-sectional configuration. To prevent the skis from moving about in the carton, spacers were inserted into the carton above and below the skis, and at each end of the skis, the spacers engaging the carton and the skis to hold the latter in place. The end flaps of the carton were then taped shut.

This practice results in a bulky package, which has an unduly large number of components and which, due to its square cross-section, does not tend to stack in a cohesive manner.

The box of this invention has fewer component parts, is made of less material, and protects the skis contained in it better than the prior art ski box described above. The box of this invention is also easier to pack and close, and easier to open and unpack than the prior art ski box described above.

The ski box of this invention is preferably formed from a blank which is scored to form four parallel, longitudinally extending panels which are erected to form an elongated box having a triangular cross-sectional configuration. End panels are secured to the open ends of the erected box, which end panels can be folded into an operative closing position after the pair of skis is inserted into the box. The end panels are then preferably stapled in place to close the ends of the box. The end panels close the ends of the box at a location which is inwardly recessed from the ends of the side panels of the box. The triangular cross-sectional configuration of the box results in a substantial degree of frictional engagement being established between the shovel end of each ski and the inner surface of the side panels of the box. Thus the pair of skis cannot move laterally or rotate while in the box. Furthermore, the mid portion of the body of each ski is cambered upwardly so that the cambered part of the ski bodies is biased into snug engagement with the inwardly converging side panels of the box thereby forcing the skis downward into snug contact with the bottom of the box at the fore and rear end portions of the skis. The end panels, referred to above, are positioned so that they engage the front and rear ends of the skis whereby forward and rearward movement of the skis within the box is restrained. The triangular shape of the box results in improved stacking stability, and permits more boxes to be stacked in a given space when compared to the square boxes.

It is, therefore, an object of this invention to provide an improved box for packaging skis wherein the skis are held firmly in position within the box by means of direct engagement between the skis and the side panels of the box.

It is a further object of this invention to provide a box of the character described which has a triangular cross-sectional configuration sized to provide snug frictional engagement between the shovel portions of the packaged skis and the side panels of the box.

It is yet another object of this invention to provide a box of the character described which has recessed end closure panels which engage opposite ends of the packaged skis and allow the projecting portion of the side panels to act as impact force-absorbing means in the event that the package is dropped on its ends.

These and other objects and advantages will become more readily apparent from the following detailed description of a preferred embodiment of the box and package of this invention in which.

Figure 1:
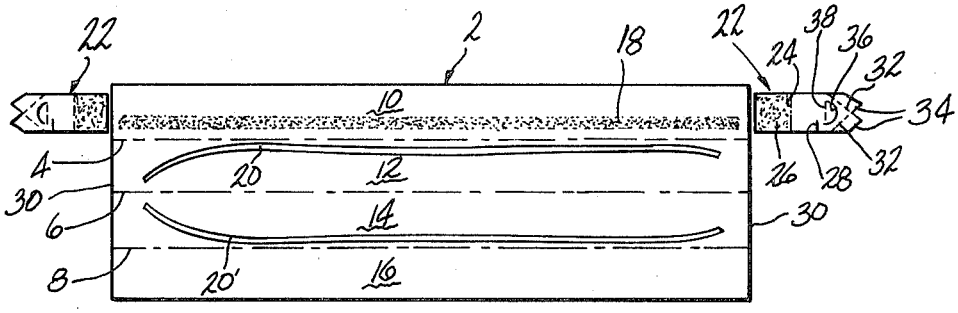
FIG. 1 is an exploded plan view of the blank from which the main body of the box is formed and the end wall panel blanks.

Referring now to the drawings, there is shown in FIG. 1 the blanks from which the ski box is formed, the blanks being made from cardboard or the like. The main body blank 2 is a generally rectangular piece having three parallel fold lines 4, 6 and 8 which divide the blank 2 into four adjacent panels 10, 12, 14 and 16. A longitudinally extending strip 18 of adhesive may be coated on one of the panels 10 for securing the blank in its erected condition. On the panels 12 and 14 there are disposed graphic representations 20 and 20′ of a ski. It will be noted that the representation 20 is the mirror image of the representation 20′. Two end closure panels 22 are provided, the panels 22 being identical in construction. Each end panel 22 includes a transverse score line 24 which forms a securement tab 26 coated with adhesive whereby the tab 26 can be secured to the bottom panel of the main body blank 2. The end panels 22 are recessed within the box and a lateral slit 28 or other indicia is formed on each end panel for alignment with the end edges 30 of the main body blank 2 to provide for proper depth of recessing of the end panels 22 within the box. A pair of converging score lines 32 are provided on the end panel 22 to define secondary securement tabs 34 whereby the end closure panels 22 may be stapled in place within the box. An arcuate cut 36 is formed in the end panels 22 for cooperation with a lateral score line 38 to form a deflectable tab which provides means for manually grasping the end panel 22 to open the box.

Figure 2:
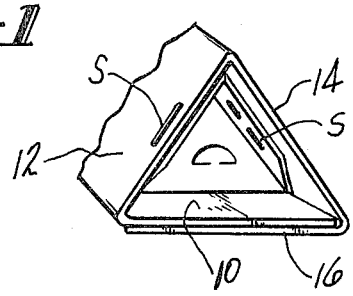
FIG. 2 is a fragmented perspective view of one end of the ski package of the invention showing the end wall construction thereof.

Referring now to FIG. 2, the construction of the end closure of the box of this invention is shown. As is apparent, the cross-sectional configuration of the box is triangular. The box body is formed by folding along the score lines 4, 6 and 8 and overlapping the panels 10 and 16. The adhesive strip 18 secures the panels 10 and 16 together to form a composite bottom wall of the box, with the panels 12 and 14 forming side walls of the box. It will be noted that the end panels 22 are recessed within the box and folded along the score line 24 to close the ends of the box. The tabs 34 are moved into juxtaposition with the box side walls 12 and 14 by folding along the score lines 32, and staples S are used to secure the tabs 34 in place.

Figure 3:
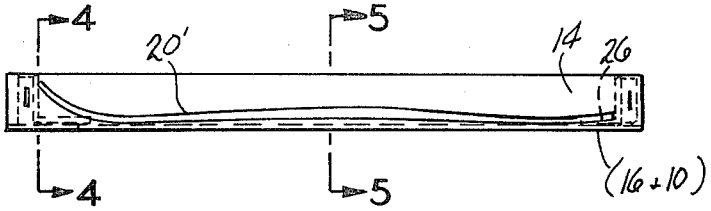
FIG. 3 is a side elevation view of the box of this invention.

Referring now to FIG. 3, it will be noted that the representation 20′ of a ski will be visible on the side wall 14 of the box, the same being true of the representation 20 on the other side wall 12 of the box. It will be noted that the end panel tab 26 is disposed inside of the box and is adhered to the bottom composite wall 16, 10 of the box.

When packaging a pair of skis in the box, the following procedure is used. The box is erected into its triangular configuration and the end panel adjacent to the tail end of the ski representation is erected and stapled in place. The end panel adjacent to the shovel end of the ski representation is secured in place by means of the tab 26, but is left flat projecting from the end of the erected body portion, thereby leaving the box open at its "shovel" end. This is the preliminary step sequence, and a number of boxes will be thus partially erected for use in packaging pairs of skis. The pair of skis will generally be pre-packaged in a plastic bag and the skis in the bag will be oriented so that the shovels are adjacent to each other with the bottom surface of one ski lying on the top surface of the other ski. The pair of skis, thus oriented, is slid into the open end of the box tail end first so that the skis in the box will be disposed as shown on the ski representations on the side panels. The skis will be pushed into the box until the ski tails encounter the erected end panel of the box, at which time the ski shovels will be inside the box, just inwardly of the fold line 24 of the non-erected end panel. The remaining end panel is then erected and stapled in place. Thus the tail end and the shovel end of the ski pair will be engaged by the end panels of the box to hold the packaged ski pair against longitudinal movement within the box.

Figure 4:
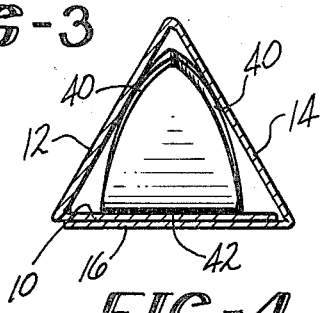
FIG. 4 is a sectional view taken along line 4—4 of FIG. 3.
Figure 5:
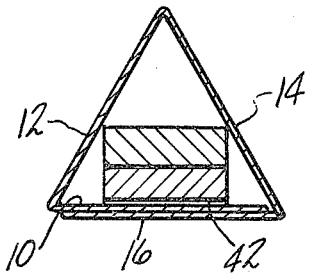
FIG. 5 is a sectional view taken along line 5—5 of FIG. 3.

Referring to FIGS. 4 and 5, it will be noted that the triangular shape of the box causes the shovel end of the packaged skis to be engaged on all sides by the composite bottom wall 10 and 16, and by the side walls 12 and 14 of the box. Specifically, the sides 40 of the ski shovel engage the side walls 12 and 14 of the box, and the bottom 42 of the lower ski engages the bottom wall 10, 16 of the box. This three sided engagement of the ski shovels positively prevents in the packaged pair of skis from twisting about its axis while in the box, thereby reducing the possibility of impact damage caused by the skis hitting each other during storage or transit. Furthermore, at approximately the mid point of the box, the camber of the packaged ski pair causes the upper corners 44 of the upper ski to be biased into engagement with the side panels 12 and 14 of the box, which in turn causes the bottom 42 of the lower ski to be biased into engagement with the bottom 10, 16 of the box at the shovel and tail ends of the skis. Some biasing of the shovel and tail ends of the skis against the end panels of the box can also result from the vertical restriction of the ski camber.

It will be readily appreciated that the ski pair packaged in the triangular box described above will be held snugly in place in the box without the need of any inserts, spacers, or the like being disposed in the box. If dropped on its end, the recessed construction of the box will result in deformation of the hollow end portion of the box side walls and a resulting absorbtion of impact force, thereby lowering the force imparted to the skis by such a dropping. The box can be easily and quickly filled with the skis and closed. The complete package takes up less space than a conventional square ski box, and the box requires less material for its fabrication.

Since many changes and variations of the disclosed embodiment of the invention may be made without departing from the inventive concept, it is not intended to limit the invention otherwise than as required by the appended claims.

What is claimed is:

1. An improved packaging system for a pair of skis having upwardly curved, generally triangular shovel ends and cambered mid-portions consisting of:

(a) an elongated box having a triangular cross-sectional configuration;

(b) closure means closing opposite ends of said box; and (c) a pair of said skis disposed in said box, one above the other, the bottom surface of one of said skis resting upon the top surface of the other of said skis;

(d) said box being sized so that two side panels of said box are in direct frictional engagement with the shovel end of at least one of said skis, and the said cambered midportion of said one of said skis is biased by contact with said two side panels of said box to bias the fore and rear end portions of said other ski into snug engagement with the third side panel of said box; and (e) said end closure means snugly engaging the ends of said skis, whereby said skis are self-locked in fixed relation to said box and said closure means.

2. The packaging system of claim 1, wherein said closure means comprise a pair of end panels recessed within the confines of said box, whereby portions of said side panels extend beyond said end panels to provide deformable impact force-absorbing members.

* * * * *